US011300912B2

(12) United States Patent
Nishimura et al.

(10) Patent No.: US 11,300,912 B2
(45) Date of Patent: Apr. 12, 2022

(54) IMAGE FORMING APPARATUS THAT DETECTS OCCURRENCE OF IMAGE DEFECT

(71) Applicant: CANON KABUSHIKI KAISHA, Tokyo (JP)

(72) Inventors: Shizuma Nishimura, Shizuoka (JP); Koji Nihonyanagi, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/365,047

(22) Filed: Jul. 1, 2021

(65) Prior Publication Data

US 2022/0011706 A1 Jan. 13, 2022

(30) Foreign Application Priority Data

Jul. 7, 2020 (JP) ..... JP2020-117325

(51) Int. Cl.
*G03G 15/00* (2006.01)
*G03G 15/20* (2006.01)

(52) U.S. Cl.
CPC ..... *G03G 15/5062* (2013.01); *G03G 15/2053* (2013.01); *G03G 15/5041* (2013.01); *G03G 15/55* (2013.01); *G03G 15/607* (2013.01)

(58) Field of Classification Search
CPC ..... G03G 15/2053; G03G 15/5062; G03G 15/5041; G03G 15/55; G03G 15/607
See application file for complete search history.

(56) References Cited

U.S. PATENT DOCUMENTS 4,277,162 A * 7/1981 Kasahara ..... G03G 15/0855 399/298
2010/0123914 A1 5/2010 Uwatoko
2015/0177664 A1* 6/2015 Kawabe ..... G03G 15/5062 399/15

FOREIGN PATENT DOCUMENTS

JP 2009217145 A 9/2009
JP 2010122870 A 6/2010
JP 2015022063 A 2/2015
JP 2016142740 A 8/2016
JP 2020052166 A 4/2020

* cited by examiner

*Primary Examiner* — Hoang X Ngo
(74) *Attorney, Agent, or Firm* — Rossi, Kimms & McDowell LLP

(57) ABSTRACT

An image forming apparatus includes: an image forming unit configured to form an image on a sheet based on original image data; a selection unit configured to determine a non-image region of the sheet to which toner does not attach in a formation of the image by the image forming unit based on the original image data, and select, from the non-image region, a determination region depending on an image defect to be detected; a reading unit configured to read a surface of the sheet; and a control unit configured to obtain read image data by causing the reading unit to read the determination region after the image forming unit has formed the image, and perform detection processing for detecting whether the image defect has occurred based on the read image data.

13 Claims, 8 Drawing Sheets

IMAGE FORMING APPARATUS THAT DETECTS OCCURRENCE OF IMAGE DEFECT

BACKGROUND OF THE INVENTION

Field of the Invention

The present invention relates to an image forming apparatus that forms an image with use of an electrophotographic method, such as a copy machine, a printer, and a facsimile machine.

Description of the Related Art

US-2010-0123914 discloses a configuration that detects the occurrence of an image defect by reading an image that has been formed by an image forming apparatus on a recording medium. Japanese Patent Laid-Open No. 2016-142740 discloses an image forming apparatus including a reading unit that reads an image to detect the occurrence of an image defect.

According to US-2010-0123914 and Japanese Patent Laid-Open No. 2016-142740, a predetermined test image is formed on a recording medium based on original image data, and an image defect is detected by comparing read image data, which has been obtained by reading this test image, with the original image data. In this case, the image defect can be detected by performing a comparison operation only with respect to data portions corresponding to a predetermined region of the test image among the original image data and the read image data. However, in a case where the occurrence of an image defect is detected by reading an image printed by a user (hereinafter, a user image), as it is not clear what kind of image the user image is, it is necessary to compare the entirety of original image data with the entirety of read image data, which requires time in processing for detecting the image defect.

SUMMARY OF THE INVENTION

According to an present disclosure, an image forming apparatus includes: an image forming unit configured to form an image on a sheet with use of toner based on original image data transmitted from an external device; a selection unit configured to determine a non-image region of the sheet to which the toner does not attach in a formation of the image by the image forming unit based on the original image data, and select, from the non-image region, a determination region depending on an image defect to be detected; a reading unit configured to read a surface of the sheet; and a control unit configured to obtain read image data by causing the reading unit to read the determination region after the image forming unit has formed the image, and perform detection processing for detecting whether the image defect has occurred in the formation of the image on the sheet based on the read image data.

Further features of the present invention will become apparent from the following description of exemplary embodiments with reference to the attached drawings.

DESCRIPTION OF THE EMBODIMENTS

Figure 1:
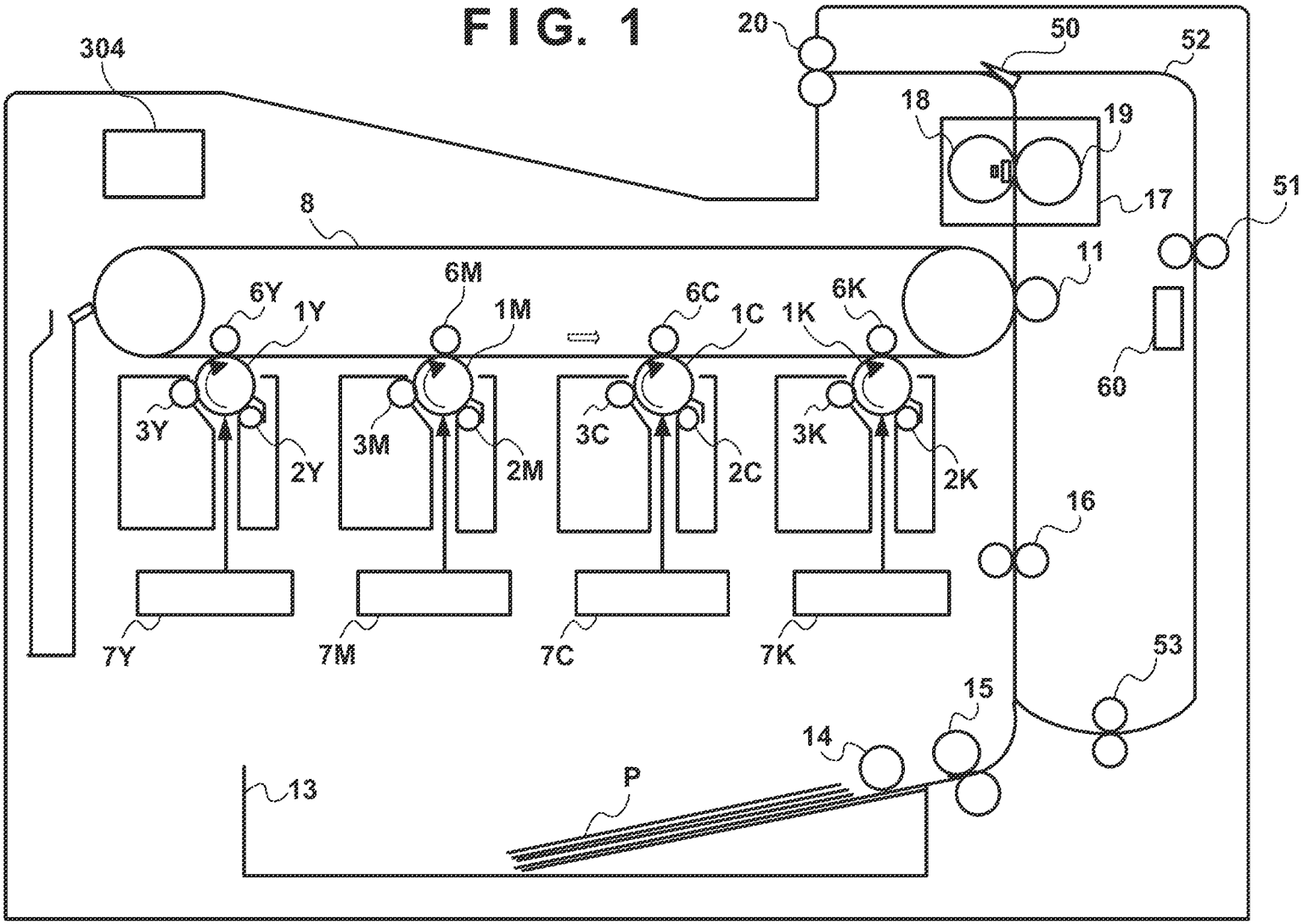
FIG. 1 is a configuration diagram of an image forming apparatus according to an embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate.

Furthermore, in the attached drawings, the same reference numerals are given to the same or similar configurations, and redundant description thereof is omitted.

First Embodiment

FIG. 1 is a configuration diagram of an image forming apparatus according to the present embodiment. Note that the characters Y, M, C, and K at the end of reference numerals in FIG. 1 respectively mean that the colors of toner images related to the formation performed by members indicated by the reference numerals are yellow, magenta, cyan, and black. However, when there is no need to distinguish between colors, reference numerals with the omission of characters at the end are used. At the time of image formation, a photosensitive member 1 is driven and rotated in the clockwise direction of the figure. A charging roller 2 charges a surface of the corresponding photosensitive member 1 so as to give a uniform electric potential thereto. An exposure unit 7 forms an electrostatic latent image on the corresponding photosensitive member 1 by exposing the surface of the corresponding photosensitive member 1 to light based on image data corresponding to a toner image to be formed. A development roller 3 develops the electrostatic latent image of the corresponding photosensitive member 1 with use of toner by outputting a development voltage, thereby forming a toner image on the corresponding photosensitive member 1. A primary transfer roller 6 outputs a primary transfer voltage, thereby transferring the toner image of the corresponding photosensitive member 1 to an intermediate transfer belt 8. At the time of image formation, the intermediate transfer belt 8 is driven and rotated in the counterclockwise direction of the figure. Note that a full-color toner image can be formed on the intermediate transfer belt 8 by transferring the toner images of respective photosensitive members 1 to the intermediate transfer belt 8 in an overlapping manner. Due to the rotation of the intermediate transfer belt 8, the toner images transferred to the intermediate transfer belt 8 are conveyed to a position opposing a secondary transfer roller 11, which is an image forming position or a transfer position.

Meanwhile, a sheet P stored in a cassette 13 is fed by a feeding roller 14 to a conveyance path, and then conveyed by a conveyance roller 15 and a registration roller 16 to the position opposing the secondary transfer roller 11. The secondary transfer roller 11 transfers the toner images of the intermediate transfer belt 8 to the sheet P by outputting a secondary transfer voltage. After the toner images have been transferred, the sheet P is conveyed to a fixing apparatus 17. The fixing apparatus 17 is provided with a fixing film 18, which includes a heating member, and a pressurizing roller 19 that is pressed into contact with the fixing film 18, and fixes the toner images on the sheet P by heating and pressurizing the sheet P.

After the toner images have been fixed, the sheet P is conveyed toward a discharge roller 20. In a case where an image is formed only on one side of the sheet P and there is no need to read the sheet P, the sheet P is discharged by the discharge roller 20 to the outside of the image forming apparatus. On the other hand, in a case where an image is formed on both sides of the sheet P, or in a case where a surface of the sheet P on which an image is formed is read, the sheet P is conveyed toward a circulation conveyance path 52 due to reverse rotation of the discharge roller 20 after the rear end of the sheet P has passed the position of a flapper 50. Note that at this time, the flapper 50 is set in such a manner that it is oriented to convey the sheet P toward the circulation conveyance path 52. On the circulation conveyance path 52, the sheet P is conveyed by a double-side conveyance roller 51 and a re-feeding roller 53. In a case where an image is formed on both sides of the sheet P, the sheet P is conveyed to the position opposing the secondary transfer roller 11 again via the circulation conveyance path 52, and toner images are transferred thereto.

Furthermore, in a case where a surface of the sheet P on which an image is formed is read, a reading unit 60 reads the surface of the sheet P on which the image is formed. Note that in the present embodiment, the reading unit 60 reads the surface of the sheet P that is conveyed between the double-side conveyance roller 51 and the re-feeding roller 53. The reading unit 60 includes a light emission element and a contact image sensor (CIS), which are not illustrated. The reading unit 60 outputs read image data that has been read to a control unit 304. The control unit 304 controls the entirety of the image forming apparatus.

Figure 2:
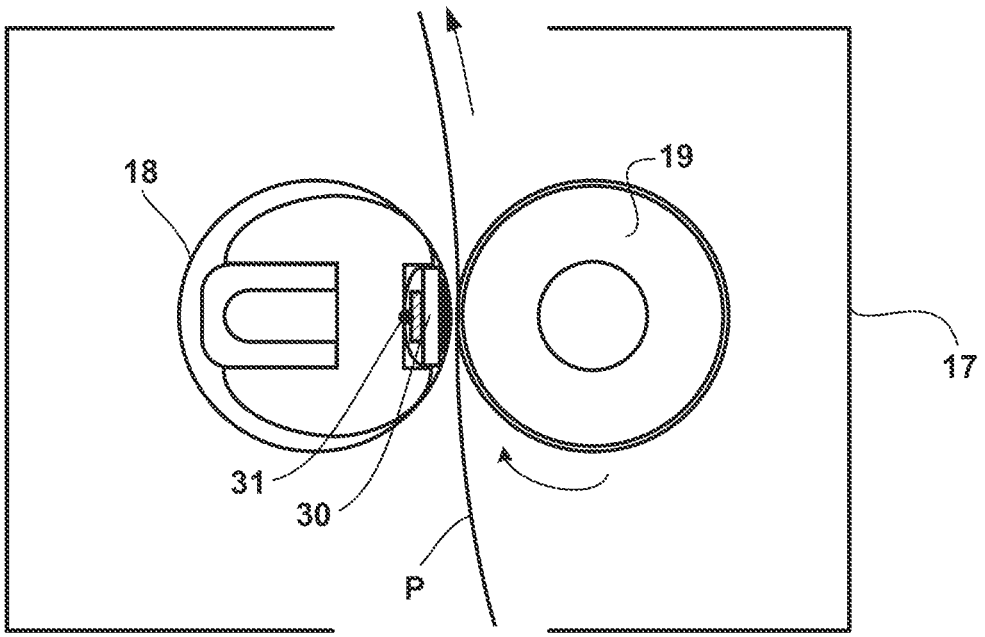
FIG. 2 is a configuration diagram of a fixing apparatus according to an embodiment.

FIG. 2 is a configuration diagram of the fixing apparatus 17. The fixing film 18 is a member in the form of an endless roller, and includes an elastic layer and a surface layer provided on an outer circumferential surface of a base layer. The elastic layer is made of a thermostable, elastic material, such as silicone rubber, for the purpose of improving the fixing properties and uniformizing glossiness. The surface layer is made of a thermostable material that is easily released from a mold, such as a fluoropolymer, in order to realize better separation from the sheet P and also to suppress toner attachment. A heater 30 is provided inside the fixing film 18. The heater 30 is a plate-shaped heat generator that rapidly heats the fixing film 18 while in contact with an inner circumferential surface of the fixing film 18. The temperature of the heater 30 is detected by a thermistor 31 that is in contact with a back surface of a substrate. The thermistor 31 notifies the control unit 304 of the detected temperature of the heater 30. Based on the result of temperature detection by the thermistor 31, the control unit 304 controls the temperature of the heater 30 so that the heater 30 has a predetermined target temperature.

The pressurizing roller 19 includes a core shaft unit, at least one elastic layer, and a surface layer. The elastic layer is made of a thermostable, elastic material, such as silicone rubber and fluorine rubber, in order to secure the width of a nip region that is formed in relation to the fixing film 18. The surface layer is made of a thermostable material that is easily released from a mold, such as a fluoropolymer, in order to prevent stains caused by toner and paper dust. The pressurizing roller 19 is driven and rotated by a non-illustrated driving unit in the clockwise direction of the figure, and the fixing film 18 rotates as it follows the rotation of the pressurizing roller 19. In a state where the heater 30 is controlled to have the predetermined target temperature, the sheet P is held between the fixing film 18 and the pressurizing roller 19 and conveyed thereby in the direction toward the upper side of the figure. In the course of this conveyance, heat and pressure are applied to the recording medium P, and toner images are fixed.

Figure 3:
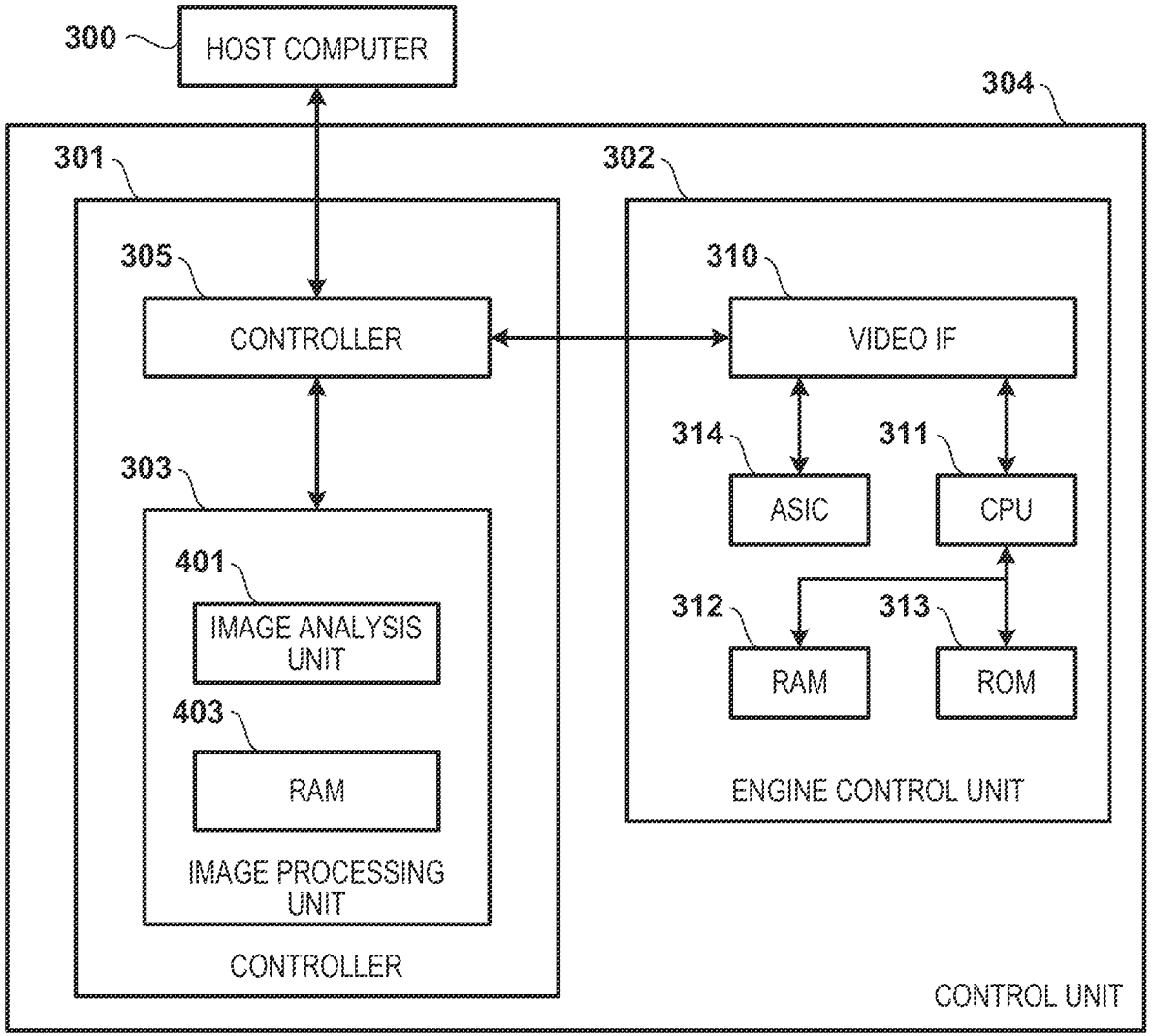
FIG. 3 is a configuration diagram of a control unit according to an embodiment.

FIG. 3 is a configuration diagram of the control unit 304. The control unit 304 includes a controller 301 and an engine control unit 302. A controller interface (IF) 305 performs processing for communication with a host computer 300 and a video IF 310 of the engine control unit 302. An image processing unit 303 generates image data (original image data) by performing various types of processing, such as halftone processing, with respect to image information received from the host computer 300, which is an external device, and outputs the original image data to the engine control unit 302. Note that a RAM 403 is used to temporarily store image data and the like in various types of processing executed by the image processing unit 303. An image analysis unit 401 decides on a region of a sheet P that is used to detect the occurrence of an image defect based on the original image data. A CPU 311 and an ASIC 314 of the engine control unit 302 controls respective components of FIG. 1 and forms an image on a sheet P based on the original image data. Note that a control program executed by the CPU 311 is stored in a ROM 313. The CPU 311 stores information that is temporarily used into a RAM 312.

In the present embodiment, the occurrence of an image defect is detected by reading a sheet P on which a user image is formed, rather than a sheet P on which a predetermined test image is formed. Note that the user image is an image that is formed by the user with use of the image forming apparatus. More specifically, the test image is an image with a predetermined pattern that is formed based on data that has been stored in a storage unit of the image forming apparatus in advance. Therefore, the content of the test image is known to the image forming apparatus. This test image is used to calibrate the image forming apparatus in correcting a positional displacement, density, and the like, and is used to confirm the normality of an image formed by the image forming apparatus. On the other hand, the user image is an image formed based on data transmitted from the host computer 300, that is to say, an external device, such as a personal computer, and the content of the user image is not known to the image forming apparatus. When original image data of the entire sheet P is compared with read image data of the entire sheet P that has been read by the reading unit 60 in order to detect an image defect from the user image that is unknown to the image forming apparatus, a period required for the detection of the image defect increases.

Therefore, in the present embodiment, the image analysis unit 401 determines a non-image region (non-formation region), in which toner does not attach to the sheet P in formation of the user image, from original image data. Then, a determination region is decided on and selected from the non-image region. The controller 301 detects whether an image defect has occurred by determining whether toner has attached in the determination region based on the read image data. In this way, the original image data and the read image data are not compared with each other throughout the entire sheet P, and thus a period required for detection of an image defect can be shortened.

Figure 4A:
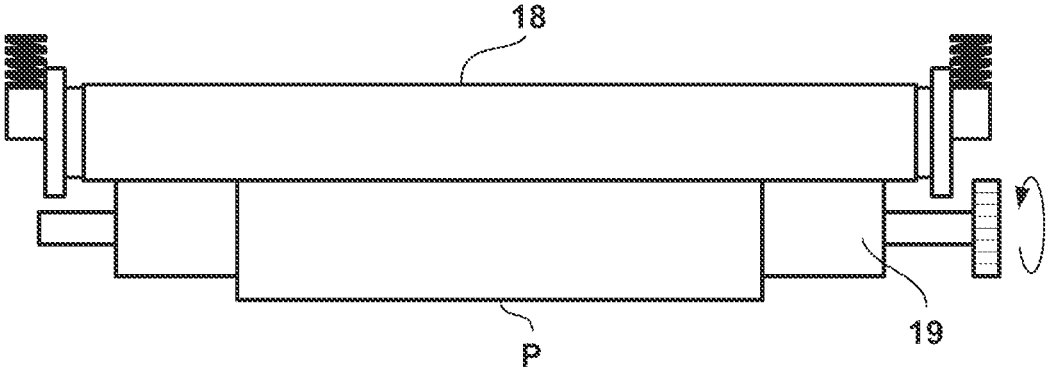
FIG. 4A to FIG. 4C are diagrams for describing the principle of the occurrence of one example of an image defect.
Figure 4B:
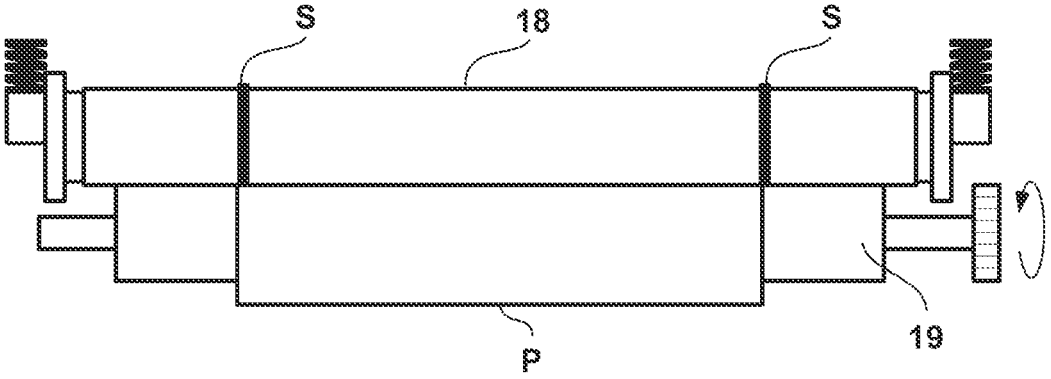
Figure 4C:
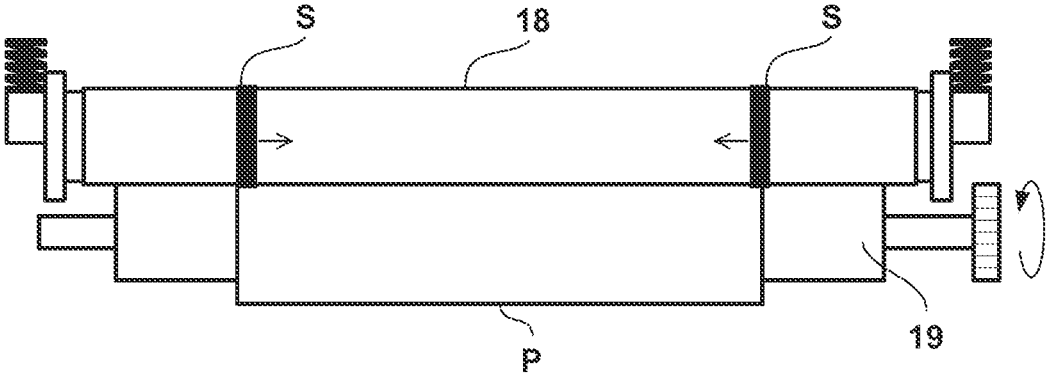

FIG. 4A to FIG. 4C are diagrams for describing the principle of the occurrence of an image defect whereby toner attaches to the vicinity of both ends in the width direction that is perpendicular to the conveyance direction of a sheet P. Note that the left-right direction of FIG. 4A to FIG. 4C is the width direction, and the sheet P is conveyed from the front side toward the back side of FIG. 4A to FIG. 4C. In general, the fixing film 18 becomes abraded due to the conveyance of the sheet P while the sheet P is held. FIG. 4A shows a state where the fixing film 18 has not been abraded. On the other hand, FIG. 4B shows a state where a part of the surface layer of the fixing film 18 has been abraded and the elastic layer is exposed. In FIG. 4B, regions S are regions in which the elastic layer is exposed. Note that abrasion of the surface layer of the fixing film 18 easily progresses in the positions of end portions of the sheet P in the width direction, which are the cut sides of the sheet P. If abrasion further progresses, the regions S grow toward the inner side as shown in FIG. 4C, and toner of the sheet P starts to attach to the regions S. If the toner that has attached to the regions S attaches to a subsequent sheet P, the subsequent sheet P undergoes an image defect whereby line-like images extending in the conveyance direction, which are not included in the original image data, are formed (vertical lines).

Figure 5:
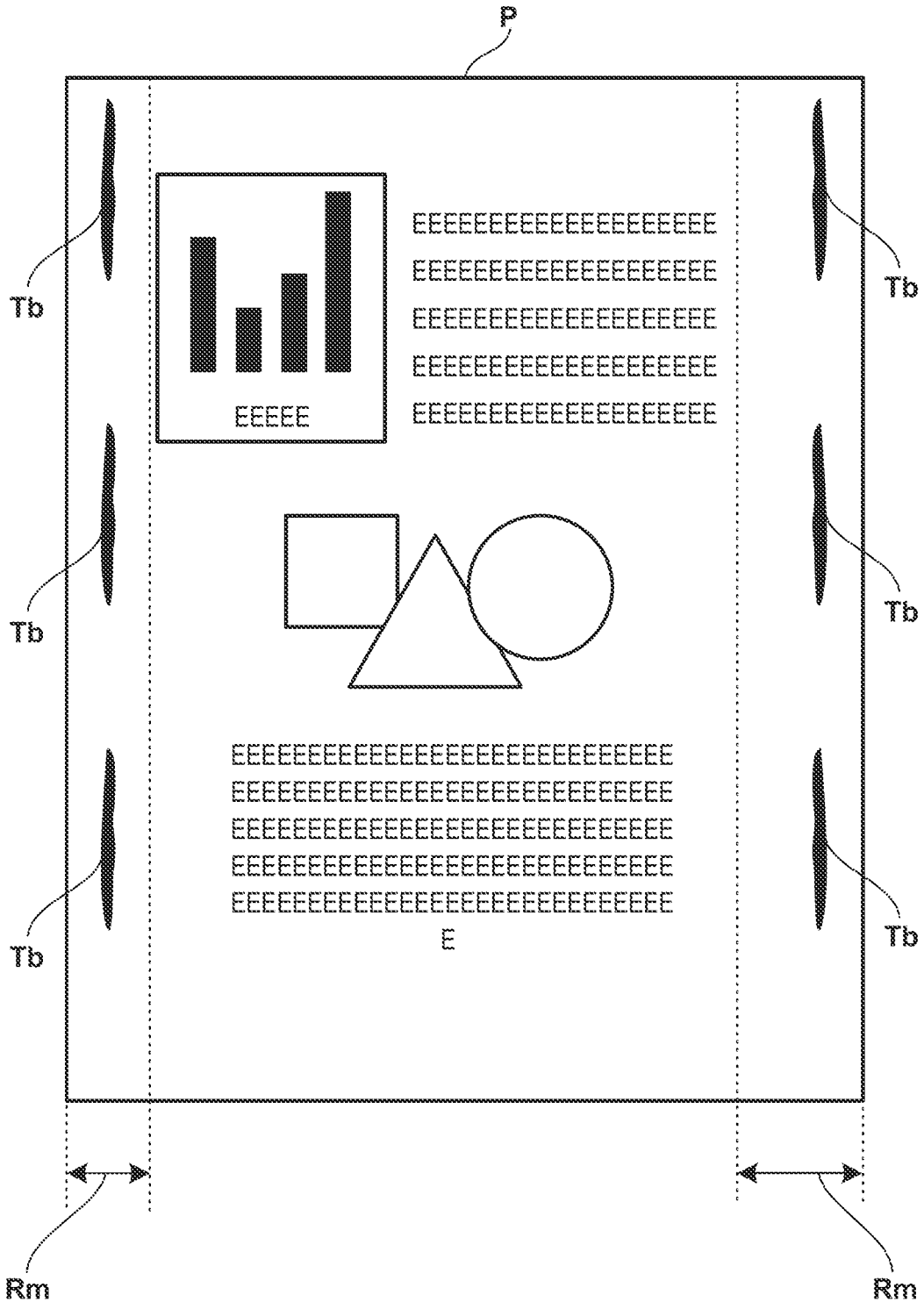
FIG. 5 is a diagram showing a sheet on which one example of an image defect has occurred.

FIG. 5 shows an example of a sheet P on which vertical lines Tb have occurred. Note that Rm in FIG. 5 indicates the length of a margin region, that is to say, a non-image region, located at both ends of the sheet P in the width direction. The vertical lines Tb are easily recognized in a case where an image has been formed on a sheet P that is larger than the type of a sheet P on which image formation has been performed a large number of times in the past in the image forming apparatus.

Figure 6:
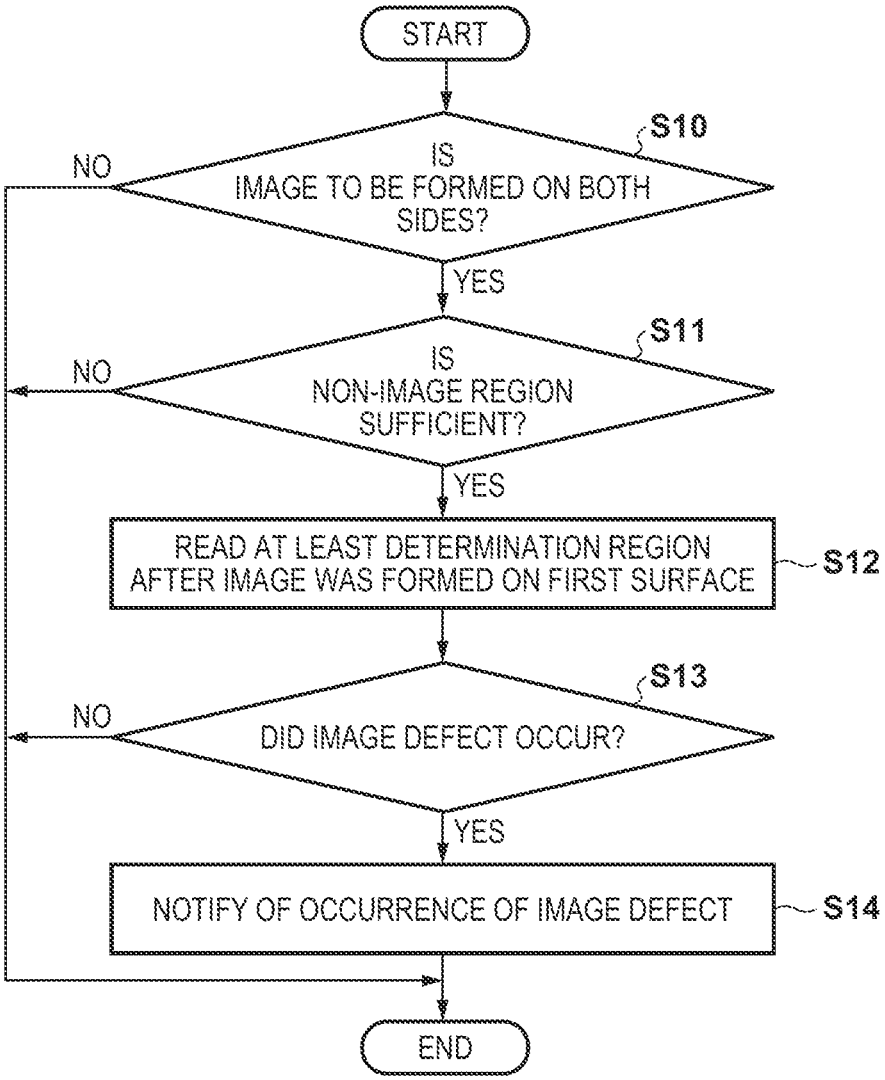
FIG. 6 is a flowchart of processing for detecting an image defect according to an embodiment.

FIG. 6 is a flowchart of processing for detecting an image defect according to the present embodiment. Once an instruction for forming an image on a sheet P has been issued, the controller 301 executes the processing of FIG. 6 for each sheet P on which an image is to be formed. In step S10, the controller 301 determines whether an image is to be formed on both sides of the sheet P, or an image is to be formed only on one side of the sheet P. When an image is to be formed only on one side, the controller 301 forms a user image on a first surface of the sheet P, and ends the processing of FIG. 6.

On the other hand, when an image is to be formed on both sides of the sheet P, the controller 301 determines whether a non-image region of the sheet P is sufficient in step S11. In the present embodiment, the image analysis unit 401 of the controller 301 determines the length Rm, in the width direction, of a margin region located on both ends of the sheet P in the width direction based on original image data. Then, when the length Rm is larger than a threshold, the controller 301 determines that the non-image region of the sheet P is sufficient. When the non-image region is not sufficient (when the length Rm is equal to or smaller than the threshold), the controller 301 forms a user image on the first surface of the sheet P, then forms a user image on a second surface of the sheet P, and ends the processing of FIG. 6.

When the non-image region (margin region) is sufficient, the controller 301 decides to use the margin region located on both ends of the sheet P in the width direction as a determination region. Then, after a user image has been formed on the first surface of the sheet P, the controller 301 causes the reading unit 60 to read at least the determination region and obtains read image data in step S12. As a section to which toner has attached has lower luminance values than a section to which toner has not attached, the controller 301 can determine a section (pixels) to which toner has attached inside the determination region by performing processing for binarizing luminance values determined from the read image data with use of predetermined values. Then, in step S13, the controller 301 determines, for example, whether toner has attached in at least a predetermined number of pixels that are consecutive along the conveyance direction of a recording medium. When toner has attached in at least a predetermined number of consecutive pixels, the controller 301 determines that a vertical line Tb representing an image defect has occurred. When it is determined that the image defect has occurred, the controller 301 notifies the user of the occurrence of the image defect in step S14. On the other hand, when it is determined that the image defect has not occurred, the controller 301 forms a user image on the second surface of the sheet P, and ends the processing of FIG. 6.

As described above, in the present embodiment, when a user image is formed, a non-image region is determined based on original image data for forming the user image, and a determination region is decided on from the non-image region. The determination region is a region which is included in the non-image region and which includes a region to which toner can attach due to the occurrence of an image defect to be detected. In the present embodiment, an image defect whereby toner attaches, in the form of a line, to the vicinity of end portions of a sheet P in the width direction is to be detected; thus, the margin region located at both ends of the sheet P in the width direction is decided to be used as the determination region. Then, after the user image has been formed, an image defect is detected by reading the determination region of the sheet P. Therefore, compared to the detection of an image defect by way of comparison between the entirety of original image data and the entirety of read image data, a period required for detection of an image defect can be reduced.

Note that in the present embodiment, in a case where a user image is formed only on one side, the reading unit 60 does not read a sheet P. However, it is also possible to adopt a configuration in which, even in a case where a user image is formed only on one side, the occurrence of an image defect is detected by conveying a sheet P to the circulation conveyance path 52 and causing the reading unit 60 to read the sheet P. Furthermore, in the present embodiment, the reading unit 60 reads a sheet P conveyed on the circulation conveyance path 52. However, it is also possible to adopt a configuration in which the reading unit 60 is placed so as to, for example, read a sheet P conveyed between the fixing apparatus 17 and the discharge roller 20. In this case, the processing for detecting an image defect can be executed, regardless of whether a user image is to be formed only on one side of the sheet P or a user image is to be formed on both sides of the sheet P. In addition, in the present embodiment, when the length Rm, in the width direction, of the margin region located on both sides of a sheet P in the width direction is equal to or smaller than the threshold, reading of the sheet P by the reading unit 60 is skipped. However, it is also possible to adopt a configuration in which, instead of performing processing of step S11 of FIG. 6, whether an image defect has occurred is always determined by reading the margin region located at both ends of the sheet P in the width direction as the determination region. Note that it is possible to adopt a configuration that causes the reading unit 60 to read only the determination region. Alternatively, it is also possible to adopt a configuration in which read image data is obtained by causing the reading unit 60 to read a region including the determination region, for example, the entirety of a sheet P, and whether an image defect has occurred is determined by using a data portion corresponding to the determination region of the read image data.

Note that in the present embodiment, the occurrence of an image defect attributed to the fixing apparatus 17 is determined. However, the present invention is applicable to detection of the occurrence of any image defect whereby toner attaches mainly to the margin region of a sheet P.

Second Embodiment

Next, a second embodiment will be described with a focus on the differences from the first embodiment. The amount of heat necessary for fixing toner images on a sheet P varies depending on the basis weight of the sheet P. Therefore, on the image forming apparatus, the temperature of the heater 30, that is to say, the fixing temperature is set to be high for a sheet P with a large basis weight. For example, in a case where an appropriate printing mode corresponding to the basis weight of a sheet P has not been selected when the user performs printing, an image defect caused by the shortage in the amount of heat for the sheet P (hereinafter, a cold offset) occurs. A cold offset refers to an image defect that occurs when toner of a sheet P attaches to the fixing film 18 due to poor heating and the toner that has attached to the fixing film 18 attaches to a sheet P again. In the present embodiment, the occurrence of this cold offset is detected.

Figure 7A:
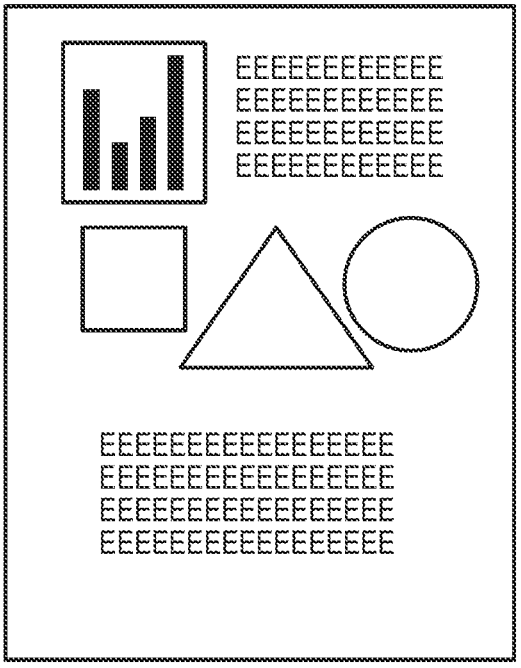
FIG. 7A to FIG. 7D are diagrams for describing processing for selecting a determination region according to an embodiment.
Figure 7B:
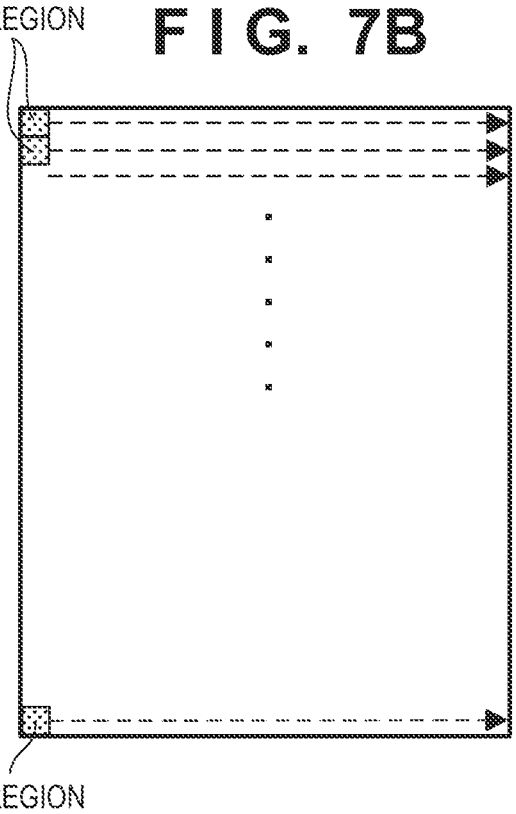

With reference to FIG. 7A to FIG. 7D, a description is now given of processing performed by the image analysis unit 401 in the present embodiment. Note, it is assumed that the left-right direction of FIG. 7A to FIG. 7D is the width direction, and a sheet P is conveyed toward the upper side of FIG. 7A to FIG. 7D. FIG. 7A shows a user image that is formed on a sheet P based on original image data. As shown in FIG. 7B, the image analysis unit 401 divides the entirety of the sheet P into sub-regions of the same size, and categorizes each sub-region as a first sub-region to which toner attaches, or a second sub-region to which toner does not attach, based on the original image data. Then, the image analysis unit 401 determines the entirety of the second sub-regions to be a non-image region. A region with hatching in FIG. 7C indicates the non-image region that is determined in a case where the user image of FIG. 7A is formed.

Subsequently, the image analysis unit 401 decides on and selects a determination region that is used to detect the occurrence of a cold offset from the non-image region. A cold offset refers to an image defect that occurs when toner of a sheet P attaches to the fixing film 18 and the toner that has attached to the fixing film 18 attaches to a sheet P again after the fixing film 18 has rotated one lap. Therefore, the image analysis unit 401 determines second sub-regions, to which toner can attach due to the occurrence of a cold offset, from the non-image region. Specifically, the image analysis unit 401 determines second sub-regions which are, in the width direction, located at the same positions as first sub-regions to which toner attaches, and which are, in the conveyance direction, located at a distance equal to the circumferential length of the fixing film 18 from the first sub-regions and arrive at the fixing apparatus 17 after the first sub-regions. Then, the image analysis unit 401 decides to use the determined second sub-regions as the determination region. A region with hatching in FIG. 7D indicates the determination region determined by the image analysis unit 401.

The controller 301 determines a region (pixels) to which toner has attached from the determination region based on read image data corresponding to the determination region, and determines that a cold offset has occurred when the size of the region to which toner has attached is equal to or larger than a predetermined number of pixels.

Figure 8:
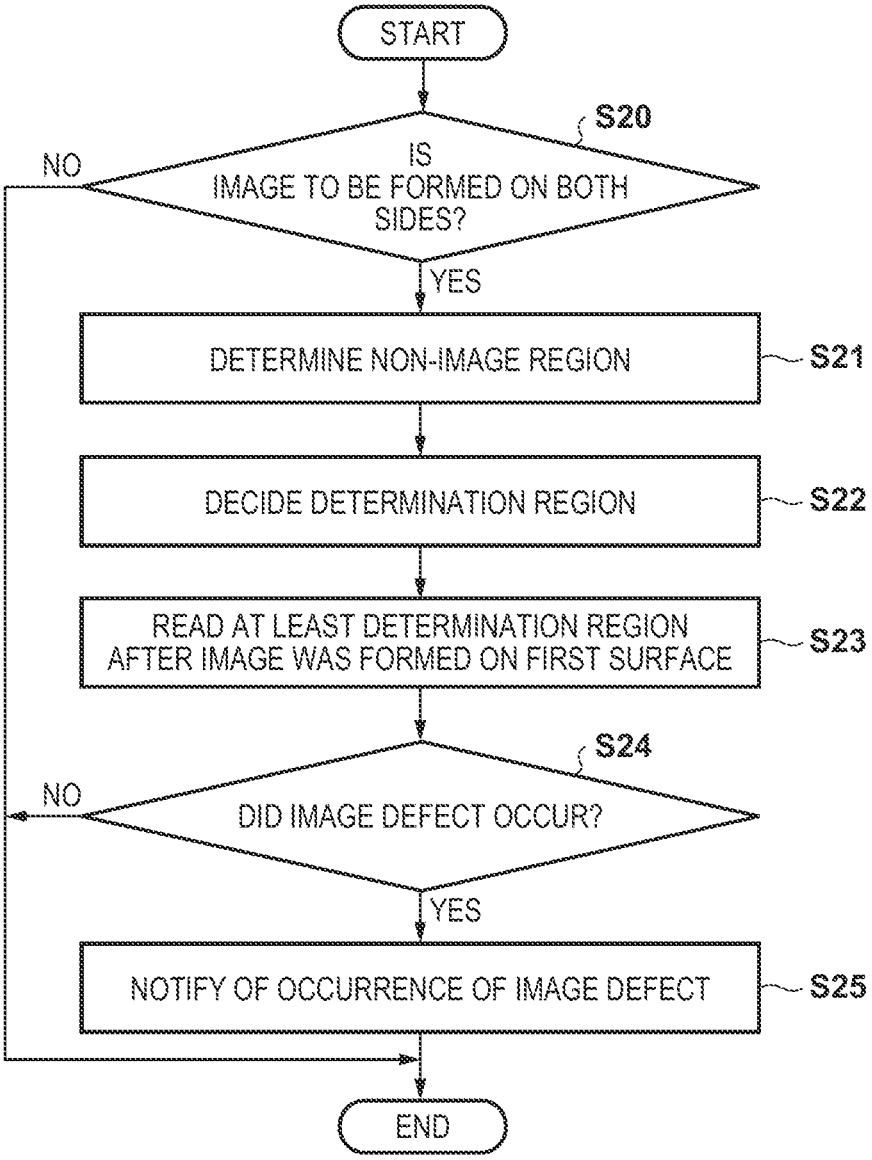
FIG. 8 is a flowchart of processing for detecting an image defect according to an embodiment.

FIG. 8 is a flowchart of processing for detecting an image defect according to the present embodiment. Once an instruction for forming an image on a sheet P has been issued, the controller 301 executes the processing of FIG. 8 for each sheet P on which an image is to be formed. In step S20, the controller 301 determines whether an image is to be formed on both sides of the sheet P, or an image is to be formed only on one side of the sheet P. When an image is to be formed only on one side, the controller 301 forms a user image on a first surface of the sheet P, and ends the processing of FIG. 8.

Figure 7C:
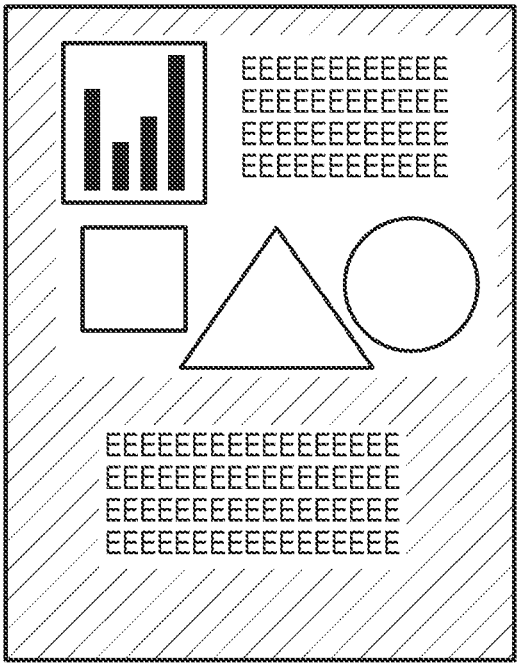
Figure 7D:
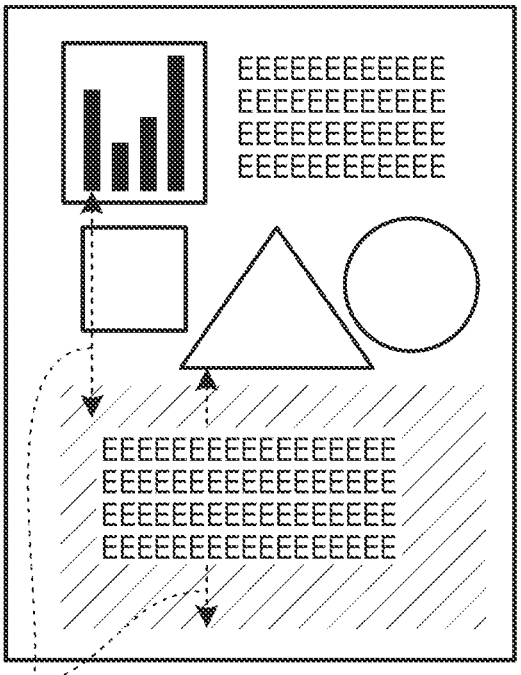

On the other hand, when an image is to be formed on both sides of the sheet P, the image analysis unit 401 of the controller 301 determines a non-image region of the sheet P in step S21 as described using FIG. 7C, and decides on a determination region in step S22 as described using FIG. 7D. After the user image has been formed on the first surface of the sheet P, the controller 301 causes the reading unit 60 to read at least the determination region and obtains read image data in step S23. Then, in step S24, the controller 301 determines whether an image defect caused by a cold offset has occurred as described above. When it is determined that the image defect has occurred, the controller 301 notifies the user of the occurrence of the image defect in step S25. On the other hand, when it is determined that the image defect has not occurred, the controller 301 forms a user image on the second surface of the sheet P, and ends the processing of FIG. 8.

As described above, in the present embodiment also, when a user image is formed, a non-image region is determined based on original image data for forming the user image, and a determination region is decided on from the non-image region. Specifically, the present embodiment decides to use a non-image region to which toner can attach due to a cold offset of a sheet P as a determination region. Then, after the user image has been formed, an image defect is detected by reading the determination region of the sheet P. Therefore, compared to the detection of an image defect by way of comparison between the entirety of original image data and the entirety of read image data, a period required for detection of an image defect can be reduced.

Note that in the present embodiment, the occurrence of an image defect attributed to the fixing apparatus 17 is determined. However, the present invention is applicable to detection of the occurrence of any image defect whereby toner of a sheet P attaches to the same sheet P via a rotary member that comes into contact with the sheet P. Furthermore, a non-image region other than a margin region can also be selected as a determination region.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-117325, filed Jul. 7, 2020 which is hereby incorporated by reference herein in its entirety.

What is claimed is:

1. An image forming apparatus, comprising:

an image forming unit configured to form an image on a sheet with use of toner based on original image data transmitted from an external device;

a selection unit configured to determine a non-image region of the sheet to which the toner does not attach in a formation of the image by the image forming unit based on the original image data, and select, from the non-image region, a determination region depending on an image defect to be detected;

a reading unit configured to read a surface of the sheet; and a control unit configured to obtain read image data by causing the reading unit to read the determination region after the image forming unit has formed the image, and perform detection processing for detecting whether the image defect has occurred in the formation of the image on the sheet based on the read image data.

2. The image forming apparatus according to claim 1, wherein the selection unit is further configured to select, as the determination region, the non-image region that is different from a margin region located on both ends of the sheet in a conveyance direction of the sheet and a width direction that is perpendicular to the conveyance direction of the sheet.

3. The image forming apparatus according to claim 2, wherein the non-image region that is different from the margin region is located between a plurality of images that are formed on the sheet based on the original image data in the conveyance direction of the sheet.

4. The image forming apparatus according to claim 1, wherein the selection unit is further configured to select, from the non-image region, a region to which toner attaches due to the image defect to be detected as the determination region.

5. The image forming apparatus according to claim 1, further comprising a fixing unit configured to fix, on the sheet, the image that has been formed by the image forming unit on the sheet, wherein the reading unit is further configured to read the surface of the sheet on which the image has been fixed by the fixing unit.

6. The image forming apparatus according to claim 5, wherein the image defect detected by the control unit is an image defect attributed to the fixing unit.

7. The image forming apparatus according to claim 5, wherein the fixing unit includes a roller-like member that heats the sheet, and the selection unit is further configured to divide the sheet into a plurality of sub-regions, categorize the plurality of sub-regions into first sub-regions to which toner attaches and second sub-regions to which toner does not attach based on the original image data, and select the determination region from the second sub-regions based on a circumferential length of the roller-like member and on positions of the first sub-regions on the sheet.

8. The image forming apparatus according to claim 7, wherein the selection unit is further configured to select, as the determination region, the second sub-regions which are located at the same position as the first sub-regions in a width direction that is perpendicular to a conveyance direction of the sheet, and which are, in the conveyance direction, located at a distance equal to the circumferential length from the first sub-regions and arrive at the fixing unit after the first sub-regions.

9. The image forming apparatus according to claim 7, wherein the image defect detected by the control unit is an image defect whereby toner that has attached to the roller-like member due to poor heating of the sheet by the roller-like member attaches to the sheet.

10. The image forming apparatus according to claim 1, wherein the selection unit is further configured to determine, based on the original image data, a margin region that is located on both ends of the sheet in a width direction that is perpendicular to a conveyance direction of the sheet, and to select the margin region as the determination region.

11. The image forming apparatus according to claim 10, wherein the control unit is further configured to perform the detection processing when a length of the margin region in the width direction is larger than a threshold.

12. The image forming apparatus according to claim 10, further comprising a fixing unit including a roller-like member that heats the sheet, and configured to fix, on the sheet, the image that has been formed by the image forming unit on the sheet, wherein the reading unit reads the surface of the sheet on which the image has been fixed by the fixing unit, and the image defect detected by the control unit is an image defect whereby toner that has attached to the roller-like member due to abrasion of a surface of the roller-like member attaches to the sheet.

13. The image forming apparatus according to claim 1, further comprising a circulation conveyance path that conveys the sheet with a first surface on which the image has been formed by the image forming unit, to a position of image formation by the image forming unit again, wherein the reading unit is further configured to read the first surface of the sheet on the circulation conveyance path, and the control unit is further configured to perform the detection processing when the image is formed on both sides of the sheet.

* * * * *